United States Patent [19]

Harris et al.

[11] 4,398,447

[45] Aug. 16, 1983

[54] VERTICAL LOADING SYSTEM FOR A GUN MOUNT

[75] Inventors: Robert M. Harris, New Hope; Edward R. Betzold, Golden Valley, both of Minn.

[73] Assignee: FMC Corporation, Chicago, Ill.

[21] Appl. No.: 235,884

[22] Filed: Feb. 19, 1981

[51] Int. Cl.[3] ..... F41F 9/04

[52] U.S. Cl. ..... 89/46; 89/33 F

[58] Field of Search ..... 89/1.802, 1.805, 33 F, 89/46

[56] References Cited

U.S. PATENT DOCUMENTS

| | | | |
|---|---|---|---|
| 2,745,317 | 5/1956 | Stanton et al. | 89/46 |
| 2,817,272 | 12/1957 | Gunder | 89/1.806 |
| 3,122,967 | 3/1964 | Johnson et al. | 89/46 |
| 3,218,930 | 11/1965 | Girouard et al. | 89/45 |
| 3,288,029 | 11/1966 | Birath | 89/33 F |
| 3,625,107 | 12/1971 | Smith et al. | 89/1.8 |
| 3,625,108 | 12/1971 | Smith et al. | 89/1.804 |
| 3,625,109 | 12/1971 | Cornelison | 89/1.807 |
| 3,625,110 | 12/1971 | Cornelison et al. | 89/1.807 |

*Primary Examiner*—Stephen C. Bentley

*Attorney, Agent, or Firm*—H. M. Stanley; R. B. Megley

[57] ABSTRACT

A gun mount having a gun cover or shield contains a gun which may be directed in both azimuth and elevation. An ammunition storage space is disposed below the gun mount. Ammunition components are combined in the storage space to provide an ammunition round with the long axis of the round substantially vertical. The barrel of the gun is elevated to the 90° or vertical position and when the breech block is opened the vertically disposed ammunition round is hoisted directed into the open breech. The round is latched in the breech while the hoisting mechanism is withdrawn and the breech is closed. Thereafter the gun may be depressed to a desired firing elevation and the round fired. The gun is then positioned at a predetermined intermediate elevation angle so that the gun breech is adjacent to a door in the gun cover which is controlled between open and closed positions. The breech is opened, the door is opened and the empty propellant case from the fired round is ejected through the open door. The gun is then repositioned to the vertical position to receive another round in the breech and the process is repeated. Conventional length ballistic projectiles and ultra-long guided projectiles may be handled by the disclosed loading system and the loading may be accomplished at any angle or azimuth or train.

5 Claims, 7 Drawing Figures

187
186
184
186
183
187
C
36
5A
36
5A
37
P
C
193
188
196
192
191
189
194
210
44
197
198
200
199
201
202
204
206
207
203
T
208
209
Pa
T
212
211
221
222
219
213
216
214
218
217
228
227
229
233
231
232
226
224
223
237
234
236
238
242
239
241
243

VERTICAL LOADING SYSTEM FOR A GUN MOUNT

BACKGROUND OF THE INVENTION

1. Field of the Invention

This invention relates to an ammunition loading system for a large caliber cannon and more particularly to such a system which automatically loads rounds including projectiles of all sizes into the breech of the cannon.

2. Description of the Prior Art

An ammunition round in general consists of three parts; a projectile, a propelling charge and a primer. Large caliber ammunition usually falls into two categories. "Separate ammunition" is the term applied to ammunition in which all three parts are separate and are brought together only at the breech of a cannon. "Semi-fixed ammunition" is the other type of large caliber ammunition wherein the projectile is separate but the propellant and the primer are fixed together. Both of the foregoing types of ammunition may include the conventional ballistic projectile or may include a guided projectile. The guided projectile has a length which is excessive for convenient handling within the confines of most gun mount shields or covers.

Ammunition loading systems are well known for large caliber cannons mounted on a gun carriage. The barrel of such a cannon is generally controllable in elevation on the carriage and the carriage is controllable in azimuth. Such a cannon is seen in the disclosure of the Girouard et al U.S. Pat. No. 3,218,930. This disclosure relates to an ammunition handling system wherein magazines provide both a projectile and a propellant charge to a hoist which lifts the projectile and charge together up to a carrier. The carrier receives the projectile and charge together and rotates to the azimuth position of the gun carriage. When the carrier reaches the gun azimuth position, the projectile and charge, referred to as a round hereinafter, is received from the carrier by a cradle on the gun carriage which is elevated about the gun support trunnion to a position such that the round is adjacent the rear of the gun and the cradle axis is parallel to the axis of the gun bore. The round is transferred from the cradle to a transfer tray and the tray is then swung downwardly to a position which is coaxial with the bore of the gun. The round is then rammed into the breech to complete the transfer from the magazine to the gun breech.

Most guided projectiles such as rockets are launched from an open breech mechanism such as the automatic rocket launchers which are disclosed in U.S. Pat. Nos. 3,625,107 and 3,625,108 to Smith et al, together with U.S. Pat. No. 3,625,109 issued to Cornelison, and U.S. Pat. No. 3,625,110 issued to Cornelison et al. A vertically disposed magazine carries a stack of rocket rounds which gravitate to the bottom of the magazine. A star wheel arrangement brings the lower-most rocket round into a tray which is aligned with a revolver chamber, and a hydraulic ram transfers the round from the tray into the revolver chamber. The chamber is then revolved into alignment with the rocket firing tube in which the rocket is ignited and from which the rocket is propelled. The preferred embodiment discloses a four chamber revolving mechanism wherein two of the chambers which are displaced by 180°, are loaded simultaneously and the other two chambers which are displaced by 180°, are fired simultaneously. Thus, as two live rocket rounds are positioned within the rocket firing tubes two empty chambers are presented to be loaded by the rocket rounds dropped into the trays from the magazine.

U.S. Pat. No. 3,122,967 issued to Johnson et al discloses a system for delivering semi-fixed rounds of ammunition from a magazine to the breech of a large caliber gun movable in azimuth and elevation. The magazine includes drum type holders for projectiles and propellant charges which deliver a projectile and a propellant charge together to a lower hoist. The lower hoist lifts the round to a movable carrier. The carrier is caused to rotate about the gun azimuth axis and to deliver the round to an upper hoist. The upper hoist rotates with the gun carriage and delivers the round to a swinging cradle which carries the round to a position where it is delivered to a transfer tray. The tray moves the round into axial alignment with the bore of the gun and a ram is utilized to insert the round into the gun breech.

SUMMARY OF THE INVENTION

The invention disclosed herein relates to a loading system for a gun having a barrel and a breech with a breech block movable between opened and closed positions. The gun is supported on a mount above an underlying storage space for ammunition components. Means is provided for elevating the gun barrel to a vertical position and other means is provided for disposing an ammunition round in vertical orientation below and aligned with the breech of the gun when the barrel is in the vertical position. A hoist is adapted to engage the vertically oriented ammunition round and means is provided for driving the hoist between lowered and elevated positions so that the hoist may lift an engaged round past an open breech block directly into the breech and then be lowered to receive another round. A latch is provided which engages the lower portion of the ammunition round in the breech to retain the round therein when the hoist is lowered. The breech block is subsequently closed and the gun directed and fired.

The method disclosed for loading an ammunition round into and clearing an empty propellant case from the breech of a gun is utilized with a gun having a breech block which is movable between open and closed positions. The gun has elevation and azimuth drives which are provided for moving the gun in elevation and train. The gun has a cover surrounding the gun housing with an opening therein which is adjacent to the breech at a predetermined gun elevation. The method includes the steps of opening the breech block and elevating the barrel to a substantially vertically disposed position while at any train position. The long axis of an ammunition round is aligned with the breech below the breech when the barrel is vertical. The round is lifted into and latched in the breech and the breech is closed. The barrel is then depressed to a desired firing elevation and the round is fired. The barrel is then brought to the predetermined gun elevation and the breech is opened. The empty case is then ejected through the gun cover opening to thereby clear the breech so that the barrel may be returned to the substantially vertically disposed position and the process repeated.

DESCRIPTION OF THE PREFERRED EMBODIMENT

Figure 1:
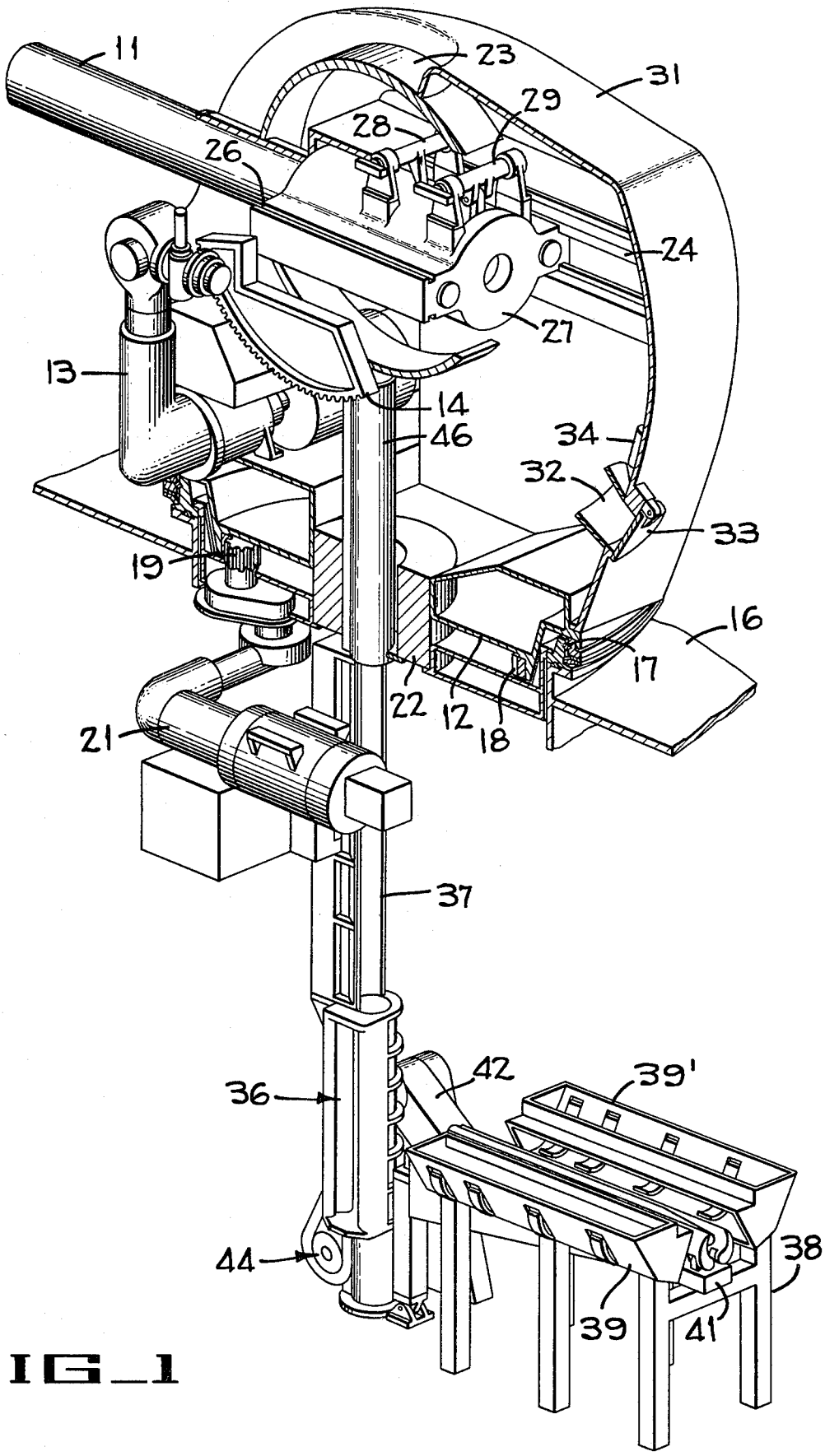
FIG. 1 is a dimetric view of the vertical ammunition loading system of the present invention.

With reference to FIG. 1 of the drawings, a large bore cannon 11 is shown which is mounted in the usual trunnions (not shown) which are carried on a gun mount base ring 12. The cannon is driven in elevation about the trunnion axis through an elevation drive train 13 which engages an elevation arc gear 14. The cannon moves with the arc gear. It should be noted that the cannon in the system disclosed herein may be driven through an angle greater than 90° by virtue of the fact that the arc of the gear is greater than 90°. The cannon may be driven to an elevation of 90°, wherein the bore of the cannon is oriented substantially orthogonally relative to a generally horizontally disposed support plate 16 for the entire gun mount. A bearing 17 is disposed between the gun mount base ring and the structure on the support plate. The support plate may be a ship's weather deck in the instance where the system is a ship-board installation.

A ring gear 18 is attached to the base ring 12 and is engaged by an azimuth or train driving pinion 19. The azimuth drive pinion gear is driven by an azimuth or train drive assembly 21 which is mounted to the support structure 16. An air and electrical slip ring transfer assembly is shown generally at 22 so that electrical and pneumatic power is made available to elements mounted on the gun mount base ring 12. The structure of the elevation and azimuth drive mechanisms may be structure included in known mechanisms of that type.

The large bore cannon 11 has a conventional gun port shield 23 attached thereto. During recoil and counter-recoil the cannon moves relative to a slide structure 24 which is supported on the trunnions. The slide structure supports the barrel housing 27 by keys that engage the barrel housing keyways 26. An extractor arm member 28 and a breech block arm member 29 are shown on the barrel housing, both of which will be described in greater detail hereinafter in conjunction with specific portions of the loading system.

The gun mount has a shield 31 surrounding the barrel housing 27 and the elevation and azimuth drive structure. The shield serves to protect such elements from exposure to the environment. A funnel-like member 32 which extends through the shield, providing an opening in the shield. At the outside end of the funnel-like member a door 33 is attached. The door may be opened or closed by a hydraulic door actuation cylinder 34. The manner in which the door is opened and closed will be described in greater detail hereinafter. The funnel-like member is positioned in the gun shield so that it will be in alignment with the cannon bore at the breech when the cannon is positioned at some intermediate elevation angle such as 33° or 35°.

In a space disposed generally below the gun mount underneath the support plate 16, storage is provided for large caliber ammunition rounds including projectiles and powder cases or propellant charges. The powder cases are generally rigid so that they will support some amount of weight in the direction of the long axis of the case. A primer is associated with the powder case when it is prepared to be placed within the breech of the cannon. In the case of ammunition for use with shipboard armament, the primer is customarily assembled with the powder case prior to loading the cases aboard ship. The projectiles may be the usual ballistic type of projectiles carrying a fuse which is set in accordance with the firing data obtained during target acquisition. Alternatively the projectile may be a guided projectile which is considerably greater in length than the ballistic types. It may be seen with reference to FIG. 1 that there is a limited amount of space behind the barrel housing 27 within the gun shield 31 so that space limits the manner in which a ballistic type projectile and powder case may be rammed into the gun breech simultaneously while the cannon is at a normal firing elevation. The problem associated with providing sufficient room between the breech and the gun shield for loading in the usual fashion (using trays and handling mechanism inside the gun shield) becomes even more unmanageable when the greater length of guided projectiles is taken into consideration.

A powder case load station 36 is shown in FIG. 1 disposed at the lower end of an ammunition round hoist tube 37. The bottom end of the hoist tube is secured to an underlying surface. Also secured to the underlying surface is structure 38 which supports a pair of projectile load station receptacles 39 and 39'. A projectile load tray 41 is disposed to receive projectiles from the receptacles. The load tray is supported to move pivotally at one side of the ammunition hoist tube 37 by means of a load tray pivot arm 42. The projectile load tray receives projectiles from the receptacles 39 and 39' and pivots them into a position overlying a powder case in the load station 36. An ammunition round, including powder case and projectile, is then raised in the hoist by means of a pawl (not shown) which is driven upwardly by a hoist drive 44 assembly. The round is guided upwardly in the hoist tube by the elevated projectile load tray 41 until the round clears the load tray and enters a stationary upper hoist tube guide 46. As will be described in greater detail hereinafter, when the cannon 11 is disposed with its bore in a substantially vertical position and the breech block is open, the ammunition round may be rammed directly into the breech from the hoist 37.

Figure 3:
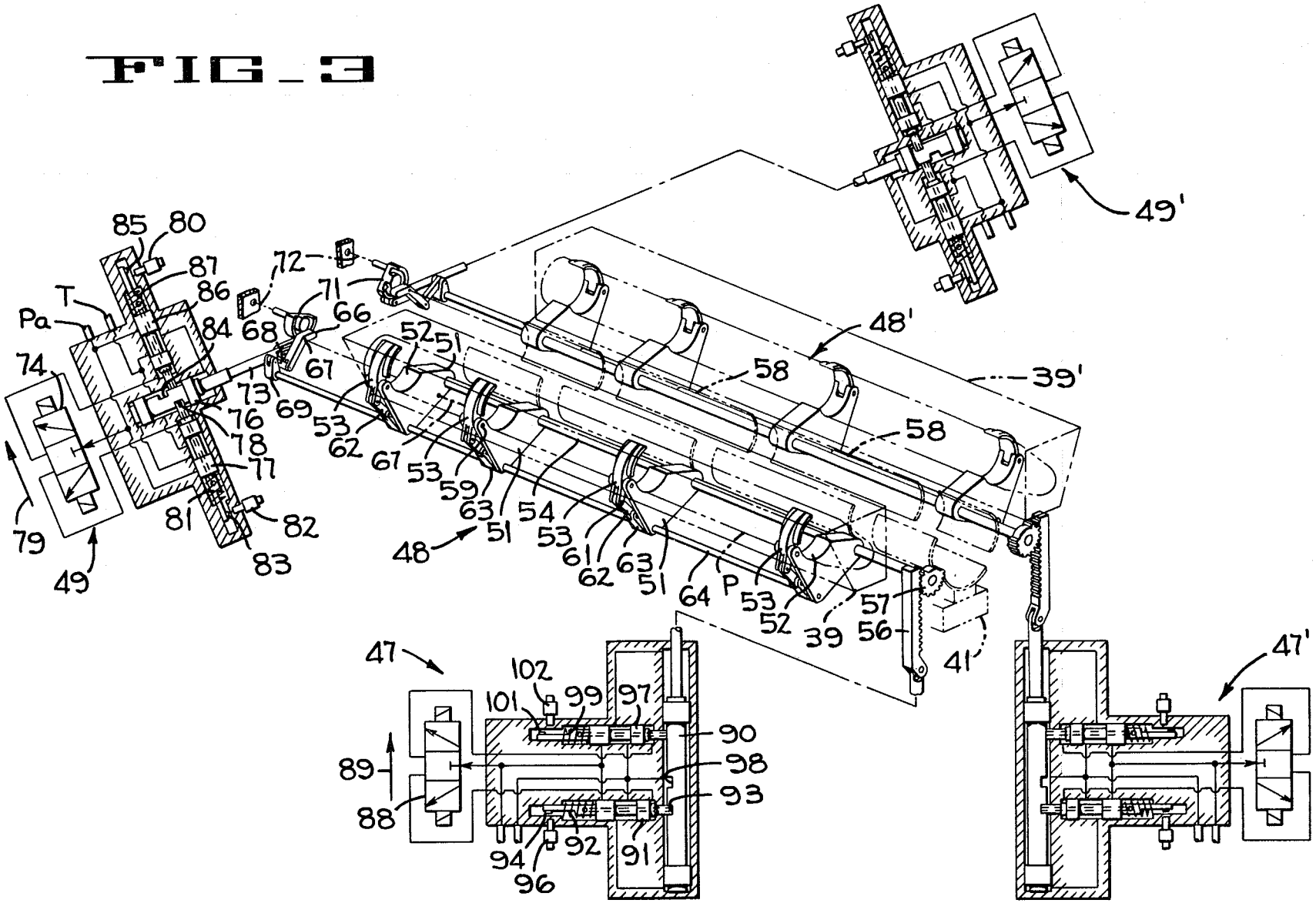
FIG. 3 is a combination perspective view and hydraulic schematic of a projectile load station in the system of the present invention.

Turning now to FIG. 3 of the drawings the manner in which the projectile load station containing the projectile load station rceptacles 39 is operated will now be described. The projectile load station is a dual operating system, the two sides of which operate substantially the same. Projectiles may be loaded, manually or otherwise, into both of the trays 39 and 39' so that sufficient projectiles will be available to the system to maintain a rapid rate of fire. A pair of projectile load station hydraulic drive controls 47 and 47' is shown together with a pair of ammunition clamp mechanisms shown generally at 48 and 48'. One half of the projectile load station mechanism operation will be described, the other half being substantially the same.

A clamped projectile P is shown in phantom lines in FIG. 3 with the nose of the projectile extending to the right in the figure. The projectile lies in a series of cradling elements 51 having contact surfaces 52 which roughly conform to the outside curvature of the projectile. The clamped projectile P being engaged over more than 180° of its outside surface by the surfaces 52 and surfaces provided by a clamp finger 53 pivotally attached to each of the cradling elements 51, the projectile may be retained by the clamp fingers as it is rotated about the longitudinal axis of a projectile transfer rod 54 in a clockwise direction as seen in FIG. 3. The transfer rod is rotated by driving a rack gear 56 upwardly, as is also seen in FIG. 3, with the rack gear meshed with a pinion gear 57 fixed to the end of the transfer rod 54. The projectile P may thus be moved (rotated about rod 54) to lie between a series of projectile engaging clamps 58 attached to the projectile load tray 41. With the projectile P disposed between the clamps 58, and with the clamps 58 first in an open position, and then in a closed position the operation of which will be hereinafter described, clamp fingers 53 are urged to an open position to allow the projectile to remain between the clamps 58 as the cradling elements 51 are rotated back to the position shown in FIG. 3.

The clamp fingers 53 are pivotally attached at pivot points 59 to the cradling elements 51 as shown in FIG. 3 and also have attached thereto at pivot points 61 a link 62. A number of arms 63 are fixed to an actuation rod 64 which is rotatably mounted in the cradling elements 51. The free end of each of the arms is pivotally mounted to the end of one of the links 62 which is remote from the pivot point 61. It may be seen that when the rod 64 is rotated in a clockwise direction as seen in FIG. 3, the arms 63 will move the lower ends of the links 62 inward into a recess in the cradling elements 51. The clamp fingers 53 will thereby be caused to rotate in a counterclockwise or opening direction about the pivot points 59.

The finger clamps 53 must be opened to both receive projectiles P and to release them to take a position between the projectile clamps 58. The mechanism which moves the clamp fingers 53 to engage and disengage a projectile includes a crank member 66 which is pivotally attached at a pivot point 67 to the cradling elements 51. Crank 66 is pivotally attached at one end to a link 68 which is in turn pivotally attached to an arm 69 fixed to one end of the finger clamp actuating rod 64.

The manner in which the crank 66 is pivoted about the pivot point 67 to thereby cause the clamp fingers 53 to open and close involves the use of an eccentric cam track 71 having an eccentric pivot axis shown at 72 in FIG. 3. A roller attached to the free end of the crank 66 is disposed within the eccentric cam track so that when the cam track is rotated in a counterclockwise direction as seen in FIG. 3, the linkage including the crank 66, link 68 and arm 69 will rotate the rod 64 in a clockwise direction causing the clamp fingers 53 to open and disengage a projectile P disposed therein. The eccentric cam track member is rotated in the counterclockwise or clamp opening direction by extension of a rod 73 extending from the clamp finger drive hydraulic control 49. Since the pivot axis for the eccentric cam track member 71 is substantially colinear with the pivot axis of the projectile transfer rod 54, it may be seen that the clamp fingers 53 may be opened and closed by the aforedescribed mechanism whether the cradling elements 51 are in a projectile receiving position as shown in FIG. 3 or a projectile transfer position interdigitated with the projectile clamps 58 in the projectile loading tray 41.

The manner in which the actuating rod 73 is driven to the extended (clamp fingers open position) or retract (clamp fingers closed position) will now be described with reference to the clamp drive hydraulic control 49. A solenoid actuated pilot valve 74 is shown in FIG. 3 in a neutral position. As discussed hereinbefore the actuating rod 73 for the clamp fingers 53 is shown in the clamp fingers closed position. The rod 73 is attached to a rod actuating piston 76 and is latched in the clamp fingers closed position by a latch piston 77 which enters a fingers closed latch notch 78 in the piston 76. When the pilot valve 74 is energized to move in the direction of the arrow 79 pressure is introduced against the face of the latch piston 77 which is closest to the actuating piston 76, thereby removing the end of the latch piston from the latch closed notch 78. The latch piston is forced to the unlatched position against the pressure of a spring 81. The relative position between the components 82 and 83 of a magnetic switch is seen to be determined by the position of the latch piston 77. The movement of the closed latch piston 77 allows hydraulic pressure to be introduced to the face of the clamp finger actuating piston 76 which causes the actuating rod 73 to extend from the clamp drive hydraulic control 49 and the clamp fingers 53 to thereby go to the open position as hereinbefore described. When the piston 76 reaches an extended position such that a latched open notch 84 in the piston 76 is aligned with one end of an open latch piston 86, a spring 87 forces the end of the piston 86 into the notch 84, thereby latching the clamp fingers 53 in an open position. With the pistons 76 and 86 in these positions, a soft iron disc 85 is positioned adjacent a magnetic proximity switch 80 to provide a signal indication of an open condition at the clamp fingers 53. It should be recognized that the proximity switch mentioned here and elsewhere in this disclosure may be of any appropriate type, including the type wherein the soft iron disc is a magnetized member and the switch includes a winding and a low reluctance core.

It may be seen by reference to FIG. 3 that when the solenoid actuated pilot valve 74 is caused to move in a direction opposite to that indicated by arrow 79 pressure is applied against the face of the open latch piston 86 to force it out of the open latch notch 84 against the spring 87. The movement of the piston 86 then admits pressure to the side of the clamp finger actuating piston 76 which causes the piston to retract the rod 73. The piston 76 is then latched in the clamp fingers closed position when the closed latch piston is forced into the closed latch notch 78 by the spring 81 thereby completing one complete cycle of opening and closing of the clamp fingers 53 in the projectile clamping mechanism 48.

The manner in which the projectile P is moved from the receiving position, shown in FIG. 3, to a position between the projectile clamps 58 may be described with reference to the projectile loading station hydraulic control 47. An actuating piston 90 is shown attached to the rack gear 56 and is shown in a position wherein the apparatus is ready to receive a projectile at the loading station receptacle 39. A solenoid actuated pilot valve 88 is shown in FIG. 3 which when actuated in the direction of the arrow 89 will introduce pressure through a line in the control body to one face of a latch piston 91. The pressure will move the latch piston against a latching spring 92 which removes one end of the piston from a latching notch 93 so that the drive piston 90 is now free to be driven in its cylinder. Movement of the latching piston 91 against the spring 92 communicates pressure to the bottom end of the cylinder containing the drive piston 90 as seen in FIG. 3. The drive piston is therefore elevated in the cylinder driving the rack 56 and the pinion 57 to thereby rotate the projectile transfer rod 54 to bring a projectile engaged by the clamp fingers 53 to a position between the projectile clamps 58 in the projectile load tray 41. The clamp fingers 53 may then be actuated to an open position, as hereinbefore described, to release the projectile after it is engaged by the projectile clamps 58. Movement of the latch piston 91 just described may be seen to alter the position of a soft iron disc 94 relative to the vicinity of a magnetic proximity switch 96 so that the switch provides an indication when this particular latch is set.

When the rack has driven the projectile to its intended position for transfer to the loading tray 41, a latching notch 98 is disposed to accept the end of a latching piston 97 which is urged into the notch by a spring 99. When the piston 97 is engaged by the latching notch 98, a soft iron disc 101 is proximate to another magnetic proximity switch 102 to thereby provide a signal indicative of latching in a load position for the projectile clamping mechanism 48.

Figure 4:
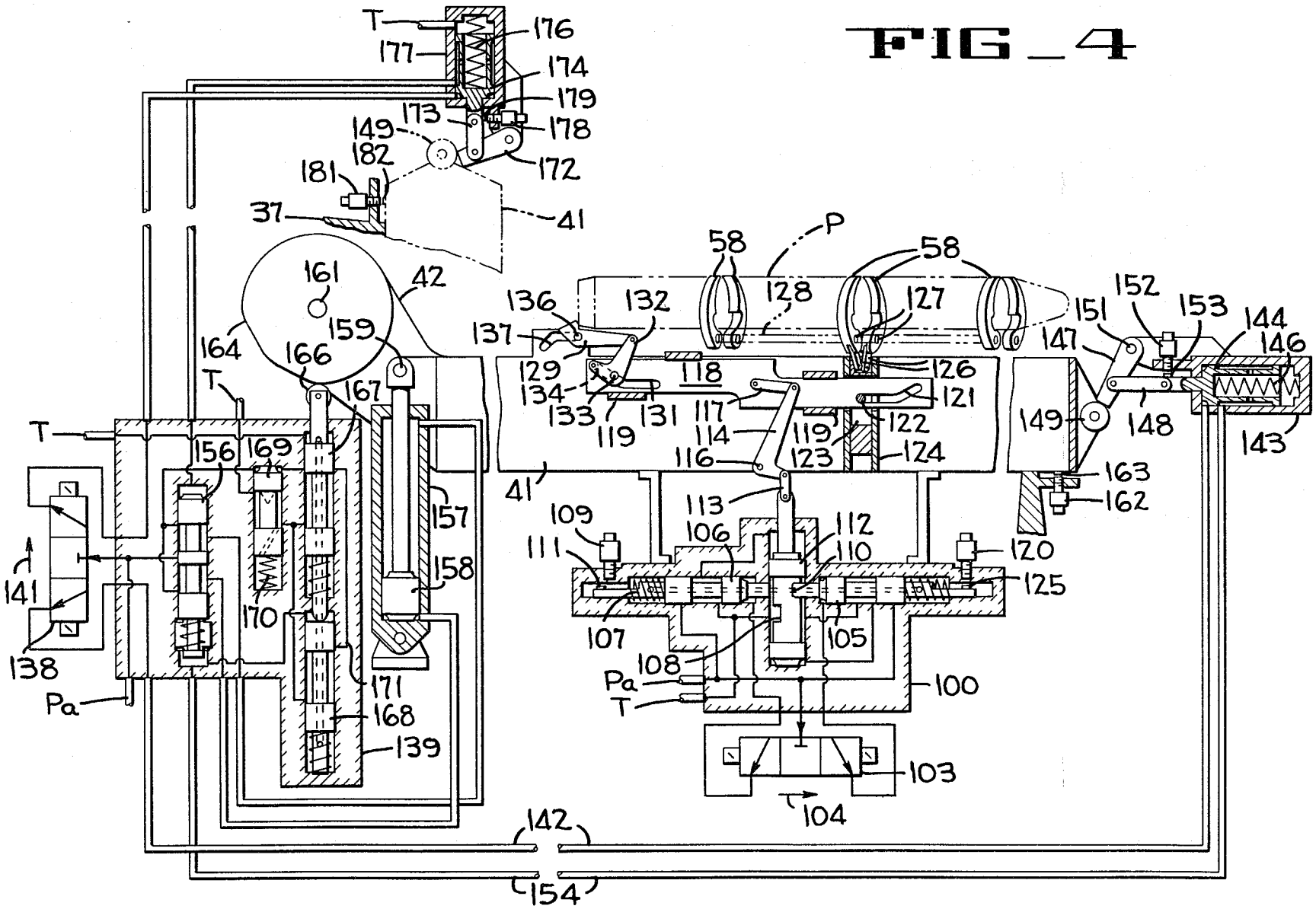
FIG. 4 is a combination perspective view and hydraulic schematic of a projectile load tray in the system of the present invention.

Turning now to FIG. 4 the manner in which the projectile load tray 41 is moved, once having received a projectile P therein, will be described. Initially, the projectile clamps 58 will be in an open position. To close the clamps 58 a solenoid actuated pilot valve 103 associated with a projectile load tray clamp control valve 100 is actuated in the direction of the arrow 104 which provides hydraulic pressure to the face of a latching piston 106 in the clamp control valve. The pressure moves the latching piston against a spring 107 to thereby lift it out of a latch notch 108. A magnetic proximity switch 109 provides a signal indicative of the position of the clamp open latch when a soft iron disc 111 is moved relative to a position adjacent to the switch by the motion of the piston 106. The motion of the piston 106 further communicates hydraulic pressure to the upper end of a clamp drive piston 112 (FIG. 4) which is coupled through a link 113 to a bell crank 114 having a pivot point at 116. The bell crank is attached through a pivoting link 117 to a sliding plate 118 which is confined to a lateral path of motion as seen in FIG. 4 by a plurality of guides 119. The plate has a forward slot 121 formed therein which carries a pin 122 attached to a block 123. The block may move in a generally vertical direction in a guide 124. Hydraulic pressure applied to the upper end of the piston 112 causes the bell crank 114 to move the plate 118 laterally to the position shown in FIG. 4, thereby forcing the pin 122 downwardly by virtue of the shape of the slot 121. The downward motion of the pin 122 and the block 123, through pivoting links 126 and connecting rods 128, causes the pairs of clamp members 58 to pivot about pivot points 127 so that the clamps in each pair approach each other in closure. The projectile clamp members 58 are attached to each other on each side of the projectile through the connecting rods 128 so that the clamps on one side all move to engage a projectile or release a projectile simultaneously.

The valve block 100 also contains a projectile secured latch piston 105. When the solenoid actuated pilot valve 103 is actuated in the direction shown by the arrow 104 and the piston 112 is urged to the position shown in FIG. 4, the piston 112 is latched there as the latch piston 105 engages the piston 112 in a latching notch 110. A magnetic proximity switch 120 is affected by a soft iron disc 125, similar to those described hereinbefore, and provides a signal indicative of a secured condition for a projectile P in the projectile load tray 41.

The motion of the sliding plate 118 may also be seen in FIG. 4 to set a supporting latch 129 which operates to engage and support the lower end of a projectile P. A rear slot 131 is formed in the sliding plate 118. A bell crank 132 is pivoted on the plate at a pivot point 133, carrying a roller 134 at one end which is disposed within the slot 131. Motion of the plate 118 which results in closing the clamps 58 to engage the projectile P also causes the bell crank 132 to rotate clockwise as seen in FIG. 4 to thereby pull the projectile latch 129 to the right. The latch is pivotally attached to one end of the bell crank and a pin 136 is also attached to the latch. The pin is disposed to travel along a slot 137 cut in the structure carrying the projectile clamps. It may be seen with reference to FIG. 4 that the slot 137 is cut such that the aforedescribed motion associated with the closing of the projectile clamps 58 causes the projectile latch 129 to rise into a position engaging the back end of a projectile P.

Having once transferred a projectile P from a projectile loading station receptacle 39 or 39' to the projectile load tray 41 and having clamped the projectile and latched it in place on the tray, it remains to elevate the projectile from a substantially horizontal position to a vertically disposed position at the hoist 37 immediately above the powder case load station 36. The foregoing is accomplished by actuating a solenoid actuated pilot valve 138 associated with a projectile load tray control valve block 139. As seen in FIG. 4 the projectile P is securely engaged by the clamps 58 and the latch 129 and the projectile load tray is latched in a down or projectile receiving position. Actuation of the pilot valve 138 in the direction indicated by the arrow 141 communicates hydraulic pressure through a line 142 to a down latch control 143 for the projectile load tray 41. A piston 144 in the latch control is spring loaded by a spring 146 in the latched position as shown in FIG. 4. Pressure in the line 142 forces the piston 144 in a direction to compress the spring 146 thereby moving a pawl 147 through a link 148 to a position which is out of the way of a latching roller 149 on the end of the projectile load tray. The pawl is rotated about a pivot point 151 when the latch is being released. A magnetic proximity switch 152 similar to those described hereinbefore operates in conjunction with a soft iron disc 153 to provide a signal indicative of actuation of the down latch control 143.

With the latch pawl 147 withdrawn and the projectile load tray 41 in an unlatched condition, pressure is applied through the down latch control 143 and a line 154 to the projectile load tray control valve block 139 to move a control valve 156 upwardly as shown in FIG. 4. Hydraulic pressure is thereby communicated with the lower end of a tray drive cylinder 157 through the cylinder housing the control valve 156. A tray drive piston 158 is thereby forced upwardly in the cylinder.

The tray drive piston is attached at a pivot point 159 to the projectile load tray 41 which causes the load tray to pivot about a pivot point 161 and to thereby approach the hoist tube 37. As long as the load tray is in the down position a magnetic proximity switch 162 provides an indication thereof as a soft iron disc 163 is seen to be in proximity therewith.

A cam surface 164 is formed on one portion of the pivot arm 42 for the projectile load tray 41. A cam follower 166 is attached to the top end of two stacked spring loaded valves having an upper portion 167 and a lower portion 168. The cam 164 is formed so that the upper valve 167 rises during the first 45° of motion of the arm 42 so that pressure returning from the upper side of the piston 158 is delivered by the piston 156 in the control valve block 139 to the top end of a metering valve 169 which is urged to a full open position by a spring 170. The upward motion of the portion 167 of the stacked valves allows hydraulic pressure to pass the upper land on the valve down into the metering valve. The higher the position taken by the valve 167 the greater is the flow allowed by the metering valve. This flow is returned to the system hydraulic tank. The higher the flow the faster the arm 42 carrying the projectile tray 41 will be caused to move. As the cam begins to depress the upper portion 167 of the stacked valves, the upper land on the piston will tend to cut off the flow to the metering valve, increasing the differential pressure across the metering valve and decelerating the movement of the projectile loading tray 41 as it comes into position adjacent the hoist 37. It should be noted that the lower portion 168 of the stacked valves is held in a down position by pressure so that one path to the metering valve 169 identified as item 171 in FIG. 4 is kept closed as the tray 41 is being raised. This is done because the surface area of the piston 158 against which pressure is exerted while the tray is being raised is greater than the surface area of the piston (top portion, FIG. 4 with piston rod attached) against which pressure is exerted when the tray is being lowered. It may be seen that when the pilot valve 138 is actuated in the direction opposite to that shown by the arrow 141 and the tray drive piston 158 is being forced downwardly in the cylinder 157, the valve 156 is forced downwardly as seen in FIG. 4. With no pressure on the upper side of the lower part 168 of the stacked valves, the lower and upper parts 168 and 167 will rise in their respective cylinders within the control valve block 139 due to compressed coil spring forces as shown. A dual path to the metering valve is thereby provided through the passage 171 and around the upper land on the upper portion 167 of the stacked valves. The metering valve 169 will therefore allow a higher oil flow volume to tank T to be attained as the arm 42 is driven back into the down position until the upper lands on the valves 167 and 168 cut off the flow to the metering valve, and decelerate the arm 42 to a stop at the lowered position.

Having raised the arm 42 of the tray 41 as hereinbefore described, the latching roller 149 will pass by an upper pawl 172 attached to an up latch control 177 mounted on the hoist tube 37 or some adjacent structure. The upper pawl may be moved through a linkage 173 against a piston 174 within the up latch control which is urged toward a latched position by a spring 176. No hydraulic pressure is required at the up latch control to effect an up latched condition. The up latch pawl 172 is released when the load tray is to be lowered and the pilot valve 138 is operated in a direction opposite to that indicated by arrow 141. The up latch control 177 operates in a fashion similar to that described for the down latch control 143. It should be noted that a magnetic proximity switch 178 is provided together with a soft iron disc 179 associated therewith so that a signal indicative of actuation of the up latch control 177 may be obtained.

The position of the projectile load tray 41 when in the up position is shown by phantom lines in FIG. 4. The load tray position is indicated by a magnetic proximity switch 181 attached to the hoist tube 37 together with an associated soft iron disc 182 attached to the load tray.

Figures 5, 5A:
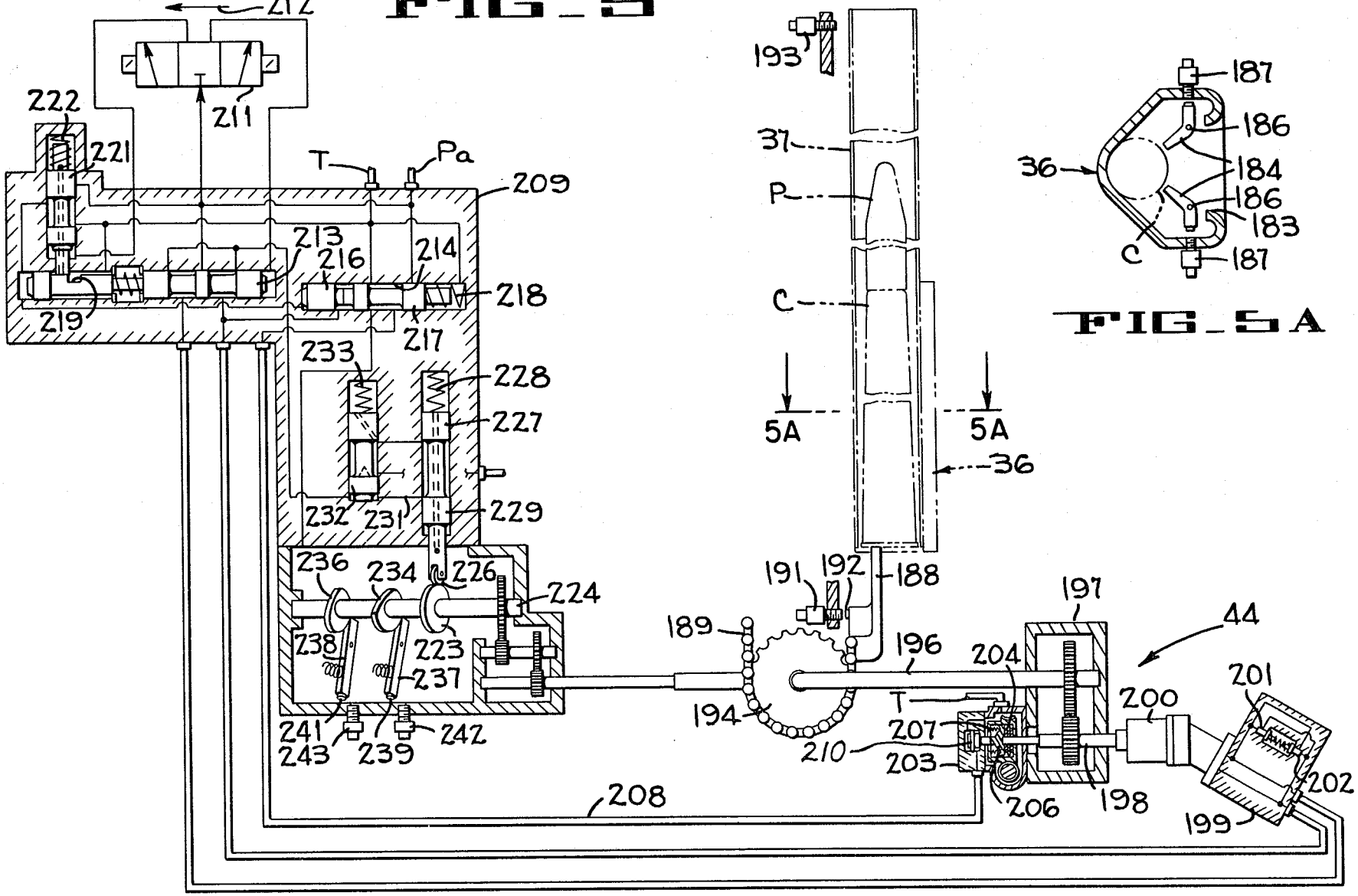
FIG. 5 is a combination perspective view and hydraulic schematic of an ammunition round hoist in the system of the present invention.
FIG. 5*a* is a section view along the line 5*a*—5*a* of FIG. 5.

Having described to this point the manner in which projectiles P are elevated into a vertical orientation adjacent the hoist tube 37, reference should now be made to FIG. 5A wherein a section is shown through the powder case load station 36 to explain how the powder cases are placed in vertical orientation at the hoist tube beneath the projectiles. A powder case C is shown in phantom line which has been placed through an opening 183 in the front side of the load station with the long axis of the case in substantially vertical orientation. A pair of pivotable arms 184 are disposed inside and on opposite sides of the opening 183. The arms are disposed to pivot about pivot points 186. The powder case C, when thrust through the opening 183, displaces the arms 184 causing the ends of the arms to be temporarily removed from positions adjacent to a pair of magnetic proximity switches 187 mounted in the sides of the powder case load station. A signal indicating the arms 184 are in the position of FIG. 5A is therefore provided. The arms are spring loaded to the position shown in FIG. 5A, operating to provide for retention of a powder case within the load station 36 once it has been loaded therein.

As a consequence of the operation of the structure and hydraulic controls discussed hereinbefore, a projectile P and a powder case C are shown disposed in overlying relation with their long axes substantially vertically oriented in FIG. 5. The details of the hoist drive assembly may be disclosed with reference to FIG. 5. An ammunition round hoist pawl 188 is shown in FIG. 5 attached to a hoist drive chain 189 supported within a chain track (not shown). The pawl is indicated as being in the down position by a signal from a pawl position switch 191 mounted on the hoist tube structure and a soft iron disc 192 associated therewith mounted on the pawl. A longitudinal slot (not shown) is formed up the rear side of the hoist tube so that the pawl may be driven up and down the hoist tube by the drive chain. Another magnetic proximity switch 193 is positioned on structure adjacent to the upper end of the hoist tube to provide a signal indicative of the condition wherein the pawl 188 is at the upper end of the tube such as exists when an ammunition round has been delivered into the breech of the cannon.

The hoist drive chain 189 may be seen in FIG. 5 to be driven by a sprocket 194 mounted on a rotating shaft 196. The shaft is driven through a gear reduction box 197 having an input shaft 198 driven by a hoist drive motor 200. The hydraulic drive motor 200 has a by-pass 199 associated therewith so that in the event the motor is stalled hydraulic fluid will by-pass the motor. The by-pass is of a usual type having poppet valves 201 and 202 which are set by spring pressure to raise off their seats and by-pass hydraulic fluid at a predetermined system pressure. The input shaft 198 extends through the gear reduction box 197 into a brake housing 203 having brake members 204 therein which are attached to the shaft 198. The braking members are forced into contact with a brake surface member 206 by a spring 207. When pressure is present in a line indicated at 208, a piston 210 in the brake housing is moved against the pressure of the spring 207 to separate the brake surface member from the brake members and thereby allow the hoist drive motor 200 to rotate the shaft 196 through the gear box 197.

A hoist control valve block 209 has a solenoid actuated pilot valve 211 associated therewith which when actuated in the direction shown by arrow 212 causes a valve 213 to move toward the left as seen in FIG. 5. This motion of the valve communicates hydraulic pressure to the hoist drive motor 200 in a sense which causes the ammunition round hoist pawl 188 to rise and thereby lift an ammunition round upward in the hoist tube 37. Hydraulic pressure is also delivered to a point in a cylinder 214 within the control valve block 209 which contains a dual valves having a left portion 216 and a right portion 217 as seen in FIG. 5. The dual valves are is urged toward a position against the left end of the cylinder 214 by a spring 218. The pressure introduced into the cylinder between the piston portions 216 and 217 forces the portion 217 against the spring 218 to a position which communicates pressure with the line 208 to thereby release the brake surface member 206.

The motion of the valve piston 213 to the left in FIG. 5 moves a latch notch 219 underneath a latching piston 221 which is spring loaded by a spring 222 to move downwardly as shown, entering the latch notch and latching the piston 213 in position during the hoist pawl 188 raise cycle.

An acceleration control cam 223 is mounted on a shaft 224 which is driven through a gear arrangement by the shaft 196 as seen in FIG. 5. A cam roller 226 bears against the cam. The cam roller is on the end of a flow control valve 227 which is spring loaded in a downward direction by the spring 228. The flow control valve 227 has a lower land 229 which, due to the shape of the cam, gradually clears the end of a passage 231 so that the passage may communicate with a metering valve 232 through the cylinder containing the flow control valve. As described in conjunction with the metering valve 169 hereinbefore, initial and final cam positions meter the hydraulic flow to a low level. Intermediate cam positions allow the lower land 229 of the flow control valve to move to allow fluid to pass through the passage 231 to the metering valve, thereby accelerating the speed of the pawl 188. The cam 223 is therefore seen to be shaped such that the pawl is slowed by metering the hydraulic flow as the pawl reaches either end of its travel at the top of the hoist tube or at the bottom thereof. Metering valve 232 is spring loaded to a full open position by spring 233.

It may be seen by further reference to FIG. 5 that for actuation of the solenoid pilot valve 211 in a direction opposite to that indicated by arrow 212 pressure is first provided against the lower end of the latch piston 221 to lift it out of the latch notch 219. The latch piston 221 continues upwardly against the force exerted by the spring 222 until pressure is communicated through the cylinder enclosing the latch piston to the left end of the valve piston 213. The valve piston is therefore driven to the right as seen in FIG. 5 communicating pressure to the hoist drive motor 200. The dual valve members 216 and 217 are also driven by the right within the valve control block 209 against the force of the spring 218 to thereby communicate pressure to the brake housing 203 and thereby release the brake on the motor shaft 198. The sense of the pressure to the hoist motor 200 is such as to transmit torque to the shaft 196 to lower the hoist pawl 188. The hydraulic flow is also conducted to the metering valve 232, through the passage 231 and the flow control valve piston 227 to provide acceleration and deceleration of the hoist pawl 188 in accordance with the shape of the cam 223.

Additional cams 234 and 236 are mounted on the cam shaft 224, bearing against members 237 and 238 respectively. A soft iron disc 239 is mounted on the bottom of the member 237 and another disc 241 is mounted on the bottom of member 238. The cam 234 is shaped so that when the hoist pawl 188 is clear of the barrel housing a signal is generated by a magnetic proximity switch 242. The cam 236 is shaped such that when the projectile and charge are both clear of the projectile loading tray 41 when the hoist pawl 188 is elevating the round, the disc 241 is proximate to another magnetic proximity switch 243 to thereby provide a signal indicative thereof. The loading tray may then be lowered to accept another projectile.

Figure 6:
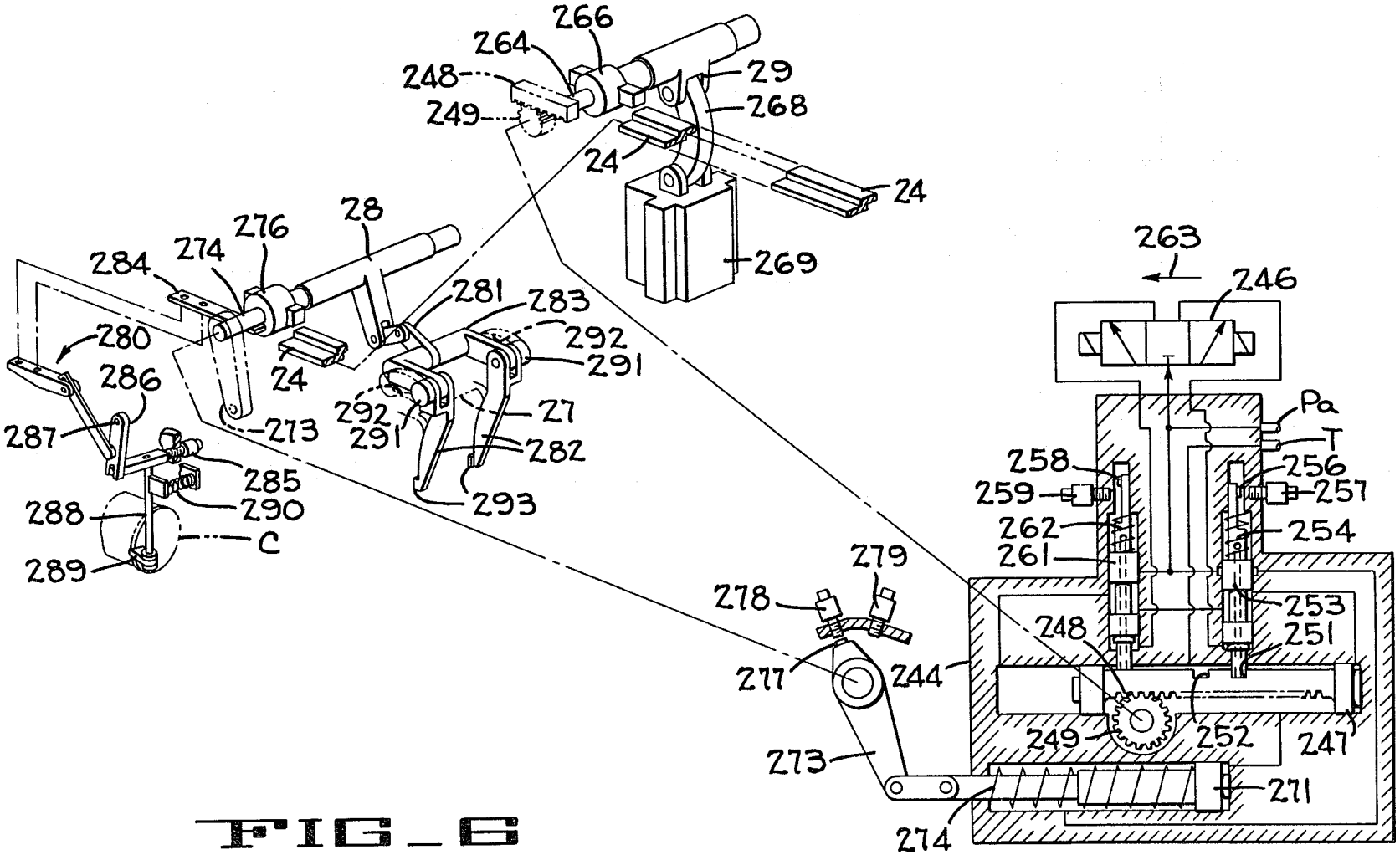
FIG. 6 is a combination perspective view and hydraulic schematic of a breech block and case ejection portion of the disclosed system.

Turning now to FIG. 6 of the drawings a breech block and case ejection control valve block 244 is shown which is actuated by a solenoid pilot valve 246. A hydraulic piston 247 is disposed within a cylinder in the control valve block 244. The piston 247 has a rack gear 248 formed thereon which is meshed with a pinion gear 249. The back of the rack gear carries a breech block down latch notch 251 and a breech block up latch notch 252. A down latch piston 253 is spring loaded by a spring 254 to engage the down latch notch when the piston 247 is in the position shown in FIG. 6. Another soft iron disc 256 is attached to one end of the piston 253 and is aligned with the magnetic proximity switch 257 when the piston 253 is in the latched position. A similar soft iron disc 258 and magnetic proximity switch 259 are aligned to indicate the latched position of a latch piston 261 which is urged into the latched notch 252 by a spring 262, when piston 247 is extended to the left in FIG. 6.

Presuming a round has just been fired from the cannon and the mechanism is positioned as shown in FIG. 6, a signal may be transmitted to the solenoid actuated pilot valve 246 to move the valve in the direction indicated by the arrow 263. Pressure is delivered to the bottom end of the down latch piston 253 causing it to rise against the spring 254 and then clear the breech block down latch notch 251. Pressure is thereby transmitted past the piston 253 to the right end of the piston 247. The piston 247 is driven to the left thereby rotating the pinion gear in a counterclockwise direction as seen in FIG. 6. A shaft 264 attached to the pinion is caused to rotate through a coupling 266 which is keyed to shaft 264. The breech block arm member 29 (FIGS. 1 and 6) is attached to the shaft 266 having a heavy pivoted link 268 connected thereto. The end of the heavy link remote from the arm 29 is pivotally attached to a breech block 269. It may be seen that counterclockwise motion of the pinion gear 249 (as seen in FIG. 6) therefore raises the breech block 269 in a pair of slides (not shown) in the barrel housing 27. Portions of the slide 24 for accommodating recoil and counterrecoil are depicted for reference purposes when correlating FIG. 6 with FIG. 1 of the drawings. It may be seen that the up latch piston 261 will be urged into the breech block up latch notch 252 by the spring 262 when the rack 248 reaches a position such that the piston and notch are aligned. The breech block is now latched in an up position.

It may also be seen that pressure is delivered to the right end of a case ejector piston 271 as shown in FIG. 6, which is spring loaded toward the position shown by a compression spring 272. Pressure is always on the end of the piston contacted by the spring 272, but the area of the piston on the right end is greater than that against which pressure is exerted on the left end as shown. The force against the right end is greater than the combined force due to hydraulic pressure and the compression spring on the left end. Therefore, with the piston 247 driven to the left in FIG. 6 the case ejector piston 271 will also be driven to the left after the piston 247 clears a hydraulic line in its leftward movement as shown. This provides a timed delay for actuation of piston 271 after piston 247 is moved so that the breech block 269 is allowed to clear the breech before a case ejection mechanism is actuated by the piston 271. The piston 271 is coupled to a case ejection actuating arm 273 which rotationally drives a shaft 274. The shaft 274 is keyed to shaft 28 by a coupling 276. The extractor shaft member 28 is attached to the shaft 274, rotating therewith. With the rotation of the case ejection actuator arm 273 which is caused by movement of the piston 271 to the left as seen in FIG. 6, a soft iron disc 277 is caused to move from a position adjacent a magnetic proximity switch 278 to a position adjacent a magnetic proximity switch 279. Switch 278 with disc 277 proximate thereto provides indication that case ejection linkage, to be hereinafter described, is retracted. Switch 279 with disc 277 proximate thereto provides a signal indicating that the spent case ejection linkage is extended.

The first portion of the arc of motion undertaken by the extractor arm member 28 straightens out a linkage 281 which is pivotally connected at one end to the arm member and at the other end to an ejector fork 283. A pair of ejector fingers 282 are pivotally attached to the tines of the ejector fork. The ejector fingers do not move as the linkage 218 is being straightened. The rotation of the arm member 28, however, does cause an arm member 284 attached to the shaft 274 to rotate. To provide clarity in FIG. 6 the arm member 284 is shown in a position which is further removed from the axis of rotation of the shaft 274 than is desired for optimum operation. Rotation of the arm member 284 causes linkage 280, shown in FIG. 6, to move a latch fork 286 counterclockwise about a pivot 287 to thereby rotate a rod 288 about the rod axis to clear a case latch 289 from a position adjacent the end of a powder case C. A magnetic proximity switch 285 provides a signal which indicates when the case latch is in the latched position. The case latch is urged by a spring 290 to the latched position and is cleared by an ammunition round advancing into the breech during loading.

With the latch 289 cleared from behind the empty case C, the linkage 281 reaches a straightened condition and the ejector fork 283 is pulled forwardly. A pair of pin members 291 projecting laterally from the fork member are drawn along a pair of slots 292 formed in structure adjacent to the fork member. The forward motion of the fork member causes the forward edges of the ejector fingers 282 to contact surfaces on barrel housing 27. The ejector fingers are thereby pivoted in a counterclockwise direction as seen in FIG. 6. Small projections 293 are formed on the ends of the fingers 282. The projections are disposed in front of the rear ring on the end of the powder case C. Therefore, the counterclockwise motion of the fingers 282 causes the projections to engage the rear ring and the empty powder case to be withdrawn rearwardly from the breech and to be thrown therefrom with some considerable force. The fingers are dropped back to the position shown in FIG. 6 when the signal actuating pilot valve 246 is terminated by the signal from switch 259 indicating the up latch position 261 is engaged in the notch 252, as hereinbefore described, and pressure is removed from the right side of the piston 271. The piston 271 will thereby be moved to the right by the spring force exerted by the spring 272 and by hydraulic pressure against the left side of the piston to return both the latch 289 and the case ejector fingers 282 to the positions shown in FIG. 6. When a new ammunition round is inserted the projections 293 are again in position forward of the rear ring on the powder case to eject that case also after firing and subsequent opening of the breech block 269.

It should be apparent that actuation of the solenoid pilot valve 246 in a direction opposite to that indicated by the arrow 263 will cause the up latch piston 261 to be lifted out of the up latch notch 252 and the piston 247 to be moved to the position in which it is shown in FIG. 6. The consequent clockwise rotation of the pinion gear 249 will clearly lower the breech block 269 into place behind the gun breech.

Figure 7:
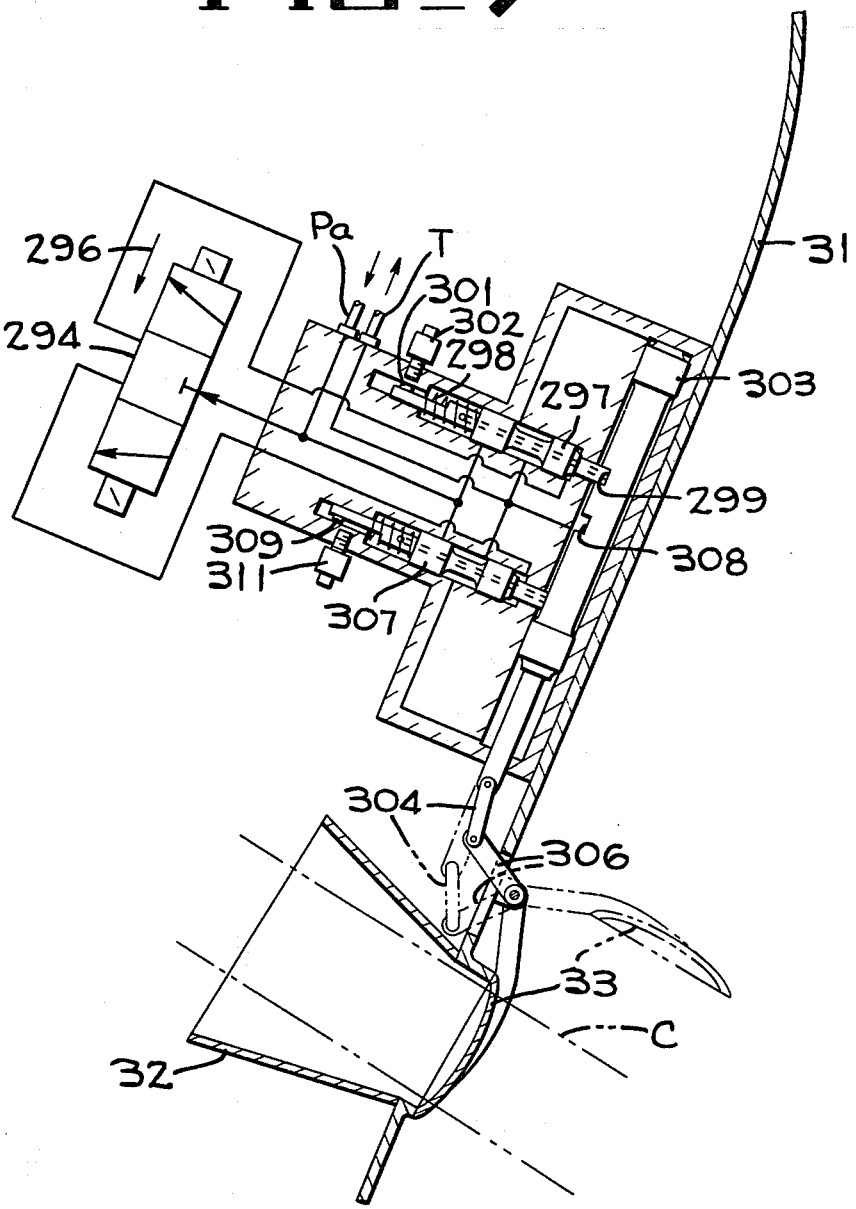
FIG. 7 is a combination enlarged section view and hydraulic schematic of an empty case ejection door in the system of the present invention.

When the empty case C is ejected from the breech as disclosed in conjunction with the description of FIG. 6, it must be afforded some path of exit from the gun shield 31. FIG. 7 shows the funnel member 32 with the case ejector door 33 covering the opening through the gun shield as shown in solid lines. When the gun barrel is elevated to some intermediate elevation position, for example 33° to 35° as mentioned hereinbefore, the bore of the cannon is brought into substantial alignment with the axis of the funnel member 32. The appropriate elevation of the cannon for case ejection being sensed, a signal is supplied to a solenoid actuated pilot valve 294 to move the valve in the direction indicated by the arrow 296. Pressure is thereby applied to the right end of a latch piston 297 as seen in FIG. 7 which forces the piston against the force exerted by a spring 298 to remove the latch piston from a door closed latch notch 299. An indication of a latched condition for the piston 297 is provided when a soft iron disc 301 is aligned with a position adjacent to a magnetic proximity switch 302. Pressure is passed through the cylinder containing the piston 297 after the piston has been moved from the latch position and is applied to the upper end of a door actuation piston 303. The door actuation piston is moved downwardly and is attached through a link 304 to a lever 306 fixed to the door 33 for opening and closing the passage through the funnel like member 32. The link 304 and the lever 306 assume the positions shown in dashed lines in FIG. 7 thereby disposing the door 33 in the position also shown by dashed lines. With the passage way through the funnel like member now clear, the empty case may be cast therethrough by the action of the ejection fingers 282 hereinbefore described. With the piston 303 in a position to open the door 33 a door open latch piston 307 is spring loaded to fall into a door open latch notch 308 and to thereby latch the door in the open position unitl the latch piston 307 is released. When the door open latch piston is engaged in the latch notch 308 a soft iron disc 309 is brought adjacent to a magnetic proximity switch 311 to provide a signal indicative thereof. It may be seen that actuation of the solenoid pilot valve in a direction opposite to that shown by the arrow 296 will communicate pressure with the lower end of the door open latch piston 307 driving it out of the notch 308 and further communicating pressure to the lower end of the door actuating piston 303 to return the mechanism to the configuration shown in solid lines in FIG. 7.

Figure 2A:
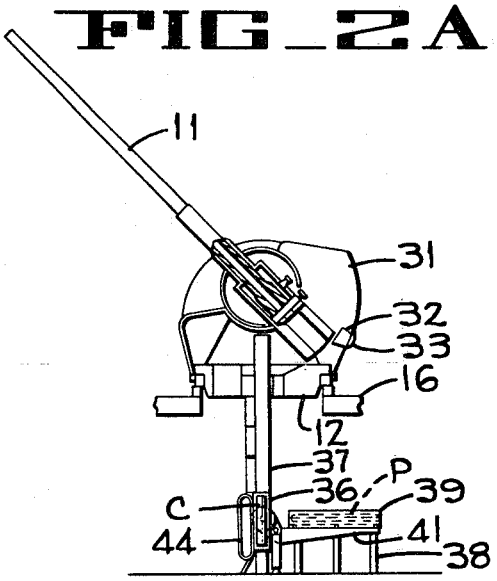
FIGS. 2*a* through 2*e* are elevation views showing portions of the operational sequence of the loading system of FIG. 1.
Figure 2B:
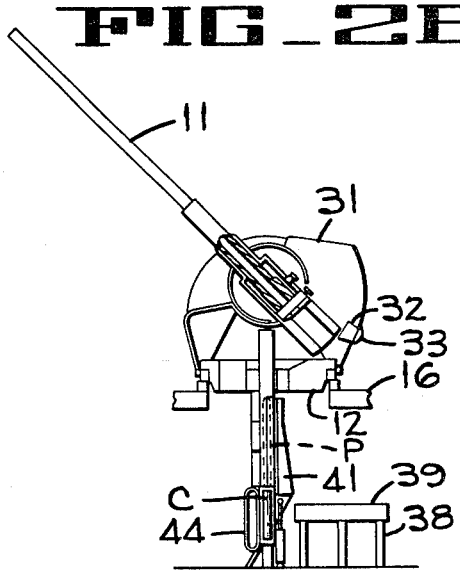
Figure 2C:
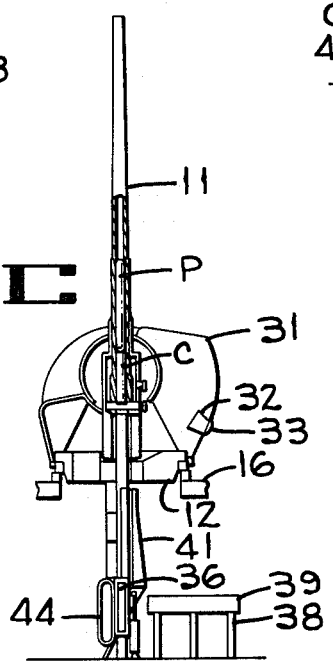
Figure 2D:
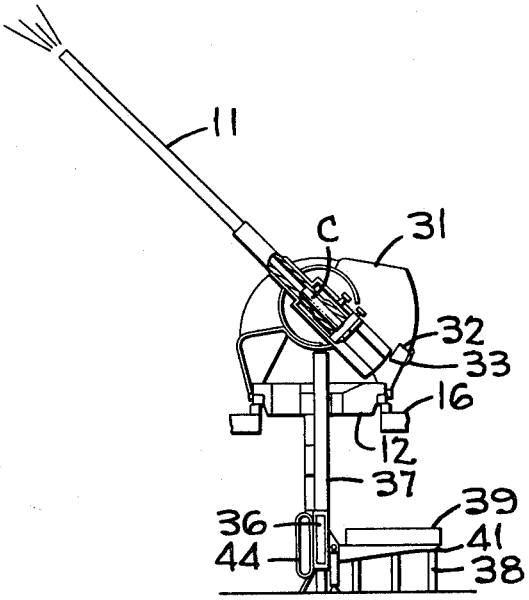
Figure 2E:
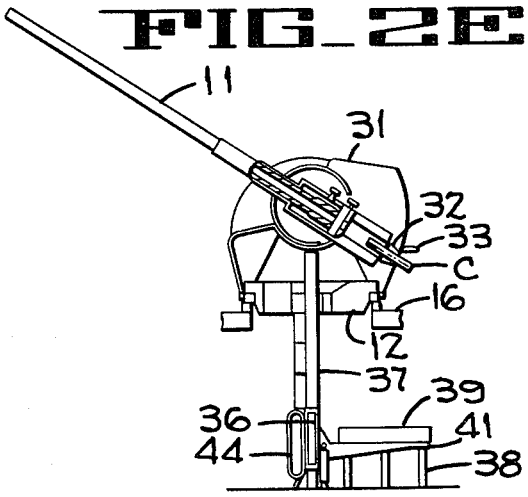

Having described the operation of the various components included in the vertical loading system, it remains to describe a sequence of operation which is programmed to occur in accordance with the signals provided by the magnetic proximity switches described throughout the description to this point. In broadest terms it may be seen by reference to FIGS. 2A through 2E that an ammunition round, including a powder case C disposed below and a projectile P disposed above is aligned by means of the aforedescribed mechanism with the long axis of the round in a vertical orientation below a gun mount being serviced. The gun breech is opened and the gun is elevated to a 90° position (barrel substantially vertical) and the round is lifted by way of the hoist tube 37 in cooperation with the projectile loading tray 41 until it is placed within and retained within the gun breech as seen in FIG. 2C. The round is latched in the breech and the breech closed. The barrel is depressed to a desired firing elevation and the round is fired as seen in FIG. 2D. The barrel 11 is then brought to the predetermined gun elevation for case ejection as the breech is opened. The case ejection door 33 is opened and the empty powder case is cleared from the breech by the mechanism described hereinbefore in conjunction with FIG. 6 and ejected from the gun cover 31 through the opened case ejection door.

In greater detail the sequence of operations in a typical cycle is as follows, assuming the barrel is elevated to 90°, the breech block is opened, the breech is empty, the ejection door 33 is closed, a fresh powder case is in the powder case load station 36 and a projectile is firmly clamped in the projectile load tray clamps:

1. Raise the projectile load tray to a vertical position adjacent the hoist tube.
2. Set the projectile fuze.
3. Release the projectile load tray clamps.
4. Raise the ammunition round hoist.
5. Lower the projectile load tray.
6. Lower the ammunition round hoist.
7. Close the breech block.
8. Depress the gun barrel to firing elevation.
9. Transfer another projectile to the load tray.
10. Close the projectile load tray clamps about the subsequent projectile to be fired.
11. Reload the powder case load station.
12. Synchronize, fire, recoil and counter-recoil.
13. Raise the projectile load tray to a vertical position adjacent the hoist.
14. Elevate the gun to align the bore with the case eject tube.
15. Open the case eject tube door.
16. Open the breech block.
17. Extract the empty case.
18. Elevate the gun barrel 90° without regard for the gun mount train angle.
19. Close the case eject tube door.
20. Set the projectile fuze.
21. Release the projectile load tray clamps.
22. Raise the ammunition round hoist.

It may be seen that a complete cycle is included from operation number 5 to operation number 22. More than one complete cycle is described here to illustrate the nature of a complete loading cycle after the initial round is fired. It should be recognized that some of the foregoing operations may be performed simultaneously to thereby compress the time required for a full cycle.

Depending upon the elevation to which the gun barrel 11 must be driven to fire each round after loading, time requirements for the complete loading and firing cycle will vary to some small degree. For example, with a 45° firing angle and a 35° ejection angle for the gun barrel 11, it takes six seconds from firing each ammunition round to depress the gun barrel to the ejection elevation, to clear the breech, to elevate the gun barrel to receive a fresh round and to depress the gun barrel to the firing angle for subsequent firing of the fresh round. Thus, the loading system disclosed herein may, under the foregoing conditions, provide a firing rate for a large bore cannon of approximately 10 rounds per minute whether the projectiles be conventional ballistic projectiles or guided projectiles.

It may be seen from the foregoing that a gun mount for a large bore cannon may be provided which has considerably reduced complexity and weight and therefore requires less maintenance. Moreover, the loading and case ejection system disclosed herein is capable of handling conventional or guided projectiles within a gun housing having a relatively small size as compared to housings surrounding guns served by conventional loading and case ejection systems.

Although the best mode contemplated for carrying out the present invention has been herein shown and described, it will be apparent that modification and variation may be made without departing from what is regarded to be the subject matter of the invention.

We claim:

1. A loading system for a gun mount wherein the gun has a barrel and a breech with a breech block movable between closed and open positions, the gun being supported above an underlying storage region for ammunition components and being surrounded by a protective cover which is movable with the gun only in azimuth, comprising means for elevating the gun barrel to a vertical position, means for disposing an ammunition round in vertical orientation, said last named means being situated below and aligned with the breech of the gun when the gun barrel is in said vertical position, a hoist engaging the vertically oriented ammunition round, means for driving said hoist to lift the round directly into the breech when the breech block is open, a latch operating to move between positions engaging and disengaging the lower end of the ammunition round in the breech, said means for driving further operating to lower the hoist away from the breech after said latch is engaged, so that the breech block may thereafter be closed and the gun directed and fired, said means for elevating further operating to bring the gun barrel to a predetermined intermediate elevation position after the round is spent by firing, means for sequentially disengaging said latch from the lower end of the spent round and extracting the spent round from the breech when the gun is in said predetermined intermediate elevation position and the breech is open, a door in the gun cover disposed adjacent to the breech when the gun is in said predetermined intermediate elevation position, and means for opening said door when the spent round is being extracted and for closing said door otherwise.

2. A loading system as in claim 1 wherein said means for disposing an ammunition round in vertical orientation comprises a projectile tray movable between a receiving position and a substantially vertical transfer position adjacent said hoist, and a propellant case loading station adjacent said hoist and beneath said transfer position.

3. A loading system as in claim 2 wherein said projectile tray comprises releasable projectile engaging clamps, said clamps engaging a projectile in said tray during movement to said transfer position and being released when adjacent said hoist, whereby said clamps operate as guides when said hoist is operated to elevate the round into the breech.

4. A loading system as in claim 1 wherein said latch includes means for clearing the latch when the round is entering the breech.

5. A method of loading an ammunition round into and clearing an empty propellant case from a breech of a gun having a breech block movable between open and closed positions, wherein elevation and azimuth drives are provided for moving the gun in elevation and train, and wherein the gun has a cover which moves with the gun in azimuth only, the cover having an opening therein adjacent to the breech when the gun is at a predetermined elevation, comprising the steps of opening the breech block, elevating the barrel to a substantially vertically disposed position while at any train position, aligning the long axis of an ammunition round with the breech and below the breech when the barrel is vertical, lifting the round into the breech, latching the round in the breech, closing the breech, depressing the barrel to a desired firing elevation, firing the round, elevating the barrel to the predetermined gun elevation, opening the breech, and ejecting the empty case through the gun cover opening.

* * * * *